US009894952B2

(12) United States Patent
Hayes

(10) Patent No.: US 9,894,952 B2
(45) Date of Patent: Feb. 20, 2018

(54) FACE SHIELD ATTACHMENT ASSEMBLY

(71) Applicant: Arthur Hayes, Fort Lauderdale, FL (US)

(72) Inventor: Arthur Hayes, Fort Lauderdale, FL (US)

( * ) Notice: Subject to any disclaimer, the term of this patent is extended or adjusted under 35 U.S.C. 154(b) by 63 days.

(21) Appl. No.: 14/835,225

(22) Filed: Aug. 25, 2015

(65) Prior Publication Data

US 2016/0050990 A1 Feb. 25, 2016

Related U.S. Application Data

(60) Provisional application No. 62/041,211, filed on Aug. 25, 2014.

(51) Int. Cl.

| | |
|---|---|
| ***A42B 1/00*** | (2006.01) |
| ***A42B 1/24*** | (2006.01) |
| ***A41D 13/00*** | (2006.01) |
| ***A61F 9/00*** | (2006.01) |
| ***A42B 1/02*** | (2006.01) |
| ***A42B 1/06*** | (2006.01) |
| ***A42B 3/22*** | (2006.01) |

(52) U.S. Cl.

CPC ..... *A42B 1/02* (2013.01); *A42B 1/061* (2013.01); *A42B 1/062* (2013.01); *A42B 1/064* (2013.01); *A42B 3/225* (2013.01)

(58) Field of Classification Search

CPC ..... A42B 1/02; A42B 1/061; A42B 1/062; A42B 1/247; A42B 3/225; A42B 1/064; A42B 1/24; A41D 13/1161; A41D 13/1184; G02C 3/02

USPC ..... 2/1, 9, 10, 12, 15, 173, 206, 209.13, 2/209.14

See application file for complete search history.

(56) References Cited

U.S. PATENT DOCUMENTS

| | | | | | |
|---|---|---|---|---|---|
| 3,035,270 | A * | 5/1962 | Boerner | A61F 9/02 | 2/10 |
| 3,797,042 | A * | 3/1974 | Gager, Jr. | A42B 3/222 | 2/10 |
| 5,125,113 | A * | 6/1992 | Yun | A42B 1/205 | 2/10 |
| 5,412,812 | A * | 5/1995 | Gatchalian | A42B 1/247 | 2/10 |
| 5,544,361 | A * | 8/1996 | Fine | A42B 1/062 | 2/10 |
| 5,615,413 | A * | 4/1997 | Bower | A42B 1/247 | 2/10 |
| 5,692,522 | A * | 12/1997 | Landis | A61F 9/025 | 128/857 |

(Continued)

FOREIGN PATENT DOCUMENTS

| | | | | |
|---|---|---|---|---|
| EP | 1344466 A1 * | 9/2003 | ..... | A42B 1/062 |
| EP | 1344466 B1 | 9/2003 | | |

*Primary Examiner* — Jameson Collier

(74) *Attorney, Agent, or Firm* — Allen F. Bennett; Bennett Intellectual Property

(57) ABSTRACT

A face shield attachment for a hat brim is removably attached to a hat, such as for example a common baseball cap. The face shield pivots upward in order to temporarily remove it from in front of a wearer. The invention includes two side shields, or lateral shields, to which the face shield may be pivotally attached. The upper edge of the side shields are attached to the sides of a brim of a hat using fasteners such as clamps.

2 Claims, 9 Drawing Sheets

(56) References Cited

U.S. PATENT DOCUMENTS

| | | | | | |
|---|---|---|---|---|---|
| 5,901,371 | A * | 5/1999 | Lee | A42B 1/065 | 2/10 |
| 5,907,868 | A * | 6/1999 | Schleger | A61F 9/029 | 2/10 |
| 6,173,447 | B1 * | 1/2001 | Arnold | A42B 1/064 | 2/10 |
| 6,237,147 | B1 * | 5/2001 | Brockman | A42B 1/247 | 2/10 |
| 6,641,266 | B1 * | 11/2003 | Lazarus | A42B 1/247 | 2/10 |
| 2003/0074708 | A1 * | 4/2003 | Hogg | A42B 1/247 | 2/9 |
| 2008/0109927 | A1 * | 5/2008 | Grilliot | A42B 3/221 | 2/10 |
| 2013/0020802 | A1 * | 1/2013 | Ng | A44C 27/00 | 289/1.5 |

* cited by examiner

FACE SHIELD ATTACHMENT ASSEMBLY

CROSS-REFERENCE TO RELATED APPLICATIONS

This application claims priority to U.S. Provisional Application Ser. No. 62/041,211 filed on Aug. 25, 2014, the contents of which are hereby incorporated in their entirety.

STATEMENT REGARDING FEDERALLY SPONSORED RESEARCH OR DEVELOPMENT

Not Applicable.

NAMES OF PARTIES TO A JOINT RESEARCH AGREEMENT

Not Applicable

REFERENCE TO SEQUENCE LISTING, A TABLE, OR A COMPUTER PROGRAM LISTING APPENDIX SUBMITTED ON A COMPACT DISC AND INCORPORATION-BY-REFERENCE OF THE MATERIAL

Not Applicable.

COPYRIGHT NOTICE

Not Applicable

BACKGROUND OF THE INVENTION

1. Field of the Invention

The present invention relates to an apparatus and system for a face shield that may be attached to head gear worn by a user. More particularly, the invention relates to a face shield that removably attaches to the brim of a cap and may be pivoted upward and downward.

2. Background Information

It is often desirable for workers who are working with or around liquid or airborne particulate to wear a protective device to prevent the liquid or particulate matter from depositing on the face. For example, when painting or applying a liquid coating material to a surface by rolling, brushing, spraying or the like, it is all too common to have the liquid coating spatter and come into contact with the applicator's head and face. This problem is exacerbated when the application of paint or liquid coating material takes place overhead, for example, when painting or texture spraying a ceiling. If care is not taken to protect the head and face from splatter, the applicator must later clean the dried coating from his face and hair. Protection is also desirable since some coating materials include harmful ingredients.

In addition to tradesmen, medical personnel also require protection from the splattering of blood or other body fluids that may spread disease. In order to encourage the wide use of face shields (especially in the painting and construction trades) a face shield that is cost-effective, comfortable to wear, easy to mount and adjust, and disposable or easy-to-clean is highly desirable. For example, a face shield that allows the wearer to wear glasses under the face shield or a face shield that absorbs perspiration that may be generated by the wearer is desirable.

There have been many attempts to provide for an adequate visor/shield assembly. Some have flipped up, some are retracted. Many are integrated into a hat and not removable for use on other head gear. Others are expensive or designed for specialized work. Previous art also required some modification to the cap or helmet in order to be properly mounted.

Furthermore there are other occupations that require a worker's eyes to be shielded while performing tasks that are only present below eye level. These occupations include, but are not limited to, welders, steel grinders and chemists. Dangers such as sparks from a grinder, blinding light from welding, or burns from chemical splashes are some of the hazards that these workers may encounter.

Traditional protective shields, sun glasses, safety glasses, and goggles do offer some protection from these hazards. However, when the worker is not performing a task that will expose the workers face and eyes to such hazards, the visor needs to positioned out of the field of view in order for the worker to perform detailed tasks at eye level. These detailed tasks may include, but are not limited to, filling out forms, reading electronic meters, locating tools, reading instructions or blueprints, taking measurements and so on. While performing these detailed tasks the worker may not need or want the protection of the eyewear.

In view of the foregoing, there is a need for a face shield attachment for a hat brim that may be removably attached to a cap and which provides adequate protection to a wearer's face.

BRIEF SUMMARY OF THE INVENTION

Accordingly, an object of the present invention is to provide a face shield attachment for a hat brim that may be removably attached to a cap and which provides adequate protection to a wearer's face.

In greater detail, a face shield attachment for a hat brim in accordance with the principles of the invention may be removably attached to a hat, such as for example a common baseball cap. The face shield may be pivoted upward in order to temporarily remove it from in front of a wearer. The face shield may include two side shields, or lateral shields, to which the face shield may be pivotally attached. The upper edge of the face shield may include a lip or other mechanism to limit downward rotation of the face.

In one embodiment, a face shield attachment for a hat brim comprises a face shield, two lateral shields, two or more fasteners extending from the lateral shields. The face shield is attached to each of the lateral shields by a pivot point and rotates about the pivot point into a downward and upward position.

In another embodiment a face shield attachment for a hat brim comprises a face shield, two lateral shields, two or more fasteners extending from the lateral shields and the assembly is removably attached to a cap having a brim. The face shield also includes a lip that abuts the brim of the cap when the face shield is in the down position.

These and other objects and advantages of the present invention will become apparent from a reading of the attached specification and appended claims. There has thus been outlined, rather broadly, the more important features of the invention in order that the detailed description thereof that follows may be better understood, and in order that the present contribution to the art may be better appreciated. There are features of the invention that will be described hereinafter and which will form the subject matter of the claims appended hereto.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION

Figure 1:
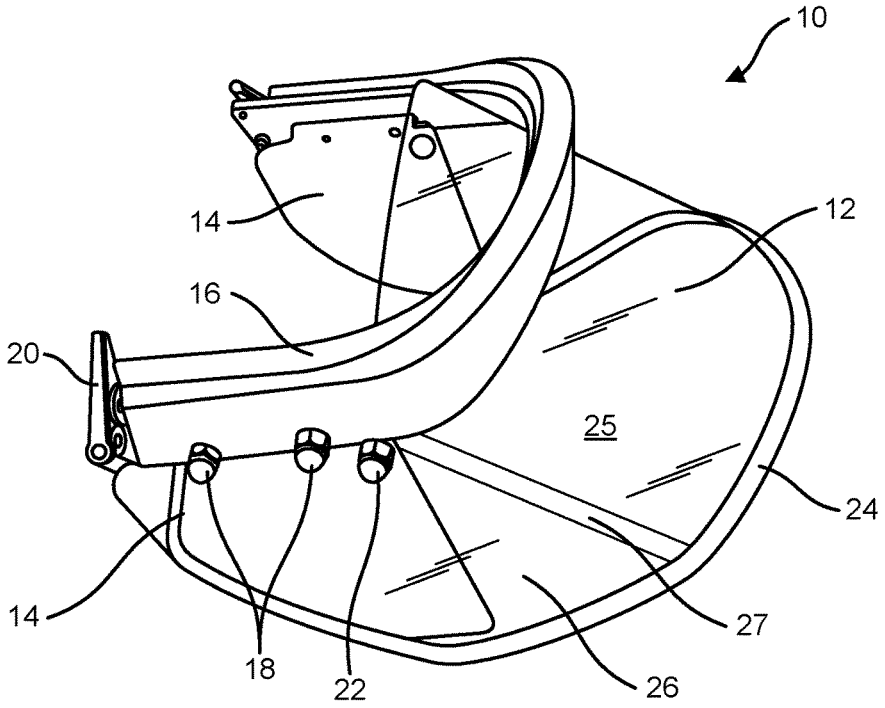
FIG. 1 is a perspective view of a face shield attachment for a hat brim in accordance with the principles of the invention.

Before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

Disclosed is a face shield attachment for a hat brim in accordance with the principles of the invention. The face shield attachment that may be removably attached to a hat, such as for example a common baseball cap. The face shield may be pivoted upward in order to temporarily remove it from in front of a wearer's face. The face shield attachment for a hat brim may include two lateral secondary shields, or side shields, to which a primary face shield may be pivotally attached. The upper edge of the face shield may include a lip or other mechanism to limit the pivotal movement of the primary face shield.

FIG. 1 shows a face shield attachment for a hat brim 10 having a primary face shield 12, two secondary lateral face shields 14 and an attachment frame 16. The secondary lateral shields 14 may be connected to the attachment frame 16 by two bolts 18. The primary face shield 12 may include two lateral wings 26 joined to an anterior face shield 25 at flexion lines 27. The primary face shield 12 may be pivotally connected to the secondary lateral shields 14 by a pivoting bolt 22. The attachment frame 16 may include two clips 20 for removable attachment to the brim of a hat. In this embodiment, the clips 20 are comprised of spring biased alligator clips. The periphery of the primary face shield 12 may optionally include a rubberized strip 24.

Figure 2:
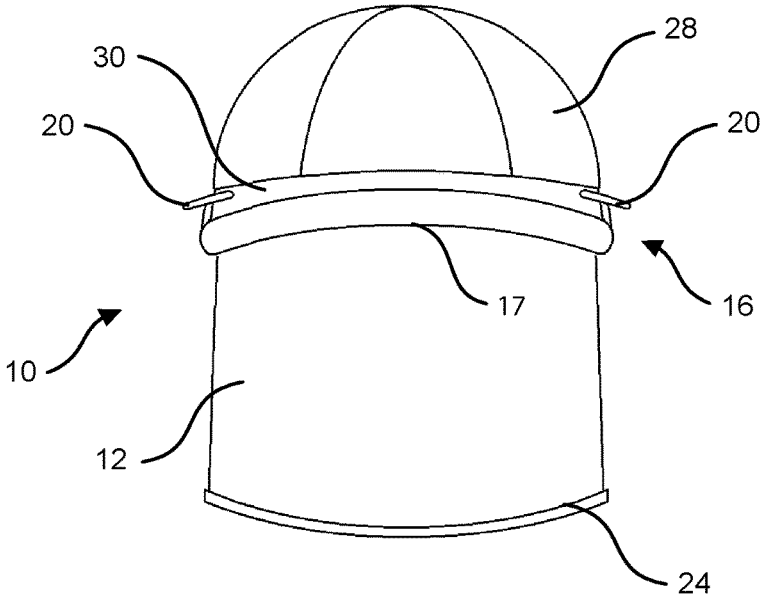
FIG. 2 is a front elevational view of a face shield attachment for a hat brim in accordance with the principles of the invention.

FIG. 2 shows the face shield attachment for a hat brim 10 affixed to a baseball cap 28. The two clips 20 are affixed to the hat brim 30 on either side. The transverse anterior region 17 of the frame 16 may be curved and order to approximate the curvature commonly used in the construction of a baseball hat brim. As will be explained in more detail below, the attachment frame 16 may include structural elements for securing the face shield attachment 10 to the brim 30 in a particular configuration.

Figure 5:
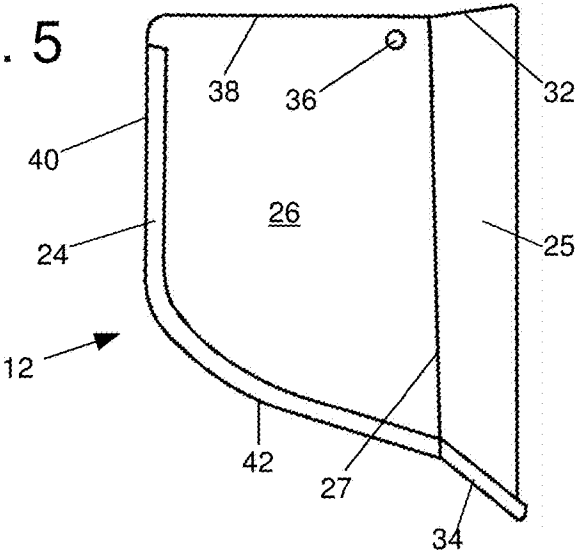
FIG. 5 is a side elevational view of a pivoting primary face shield of a face shield attachment for a hat brim in accordance with the principles of the invention.
Figure 3:
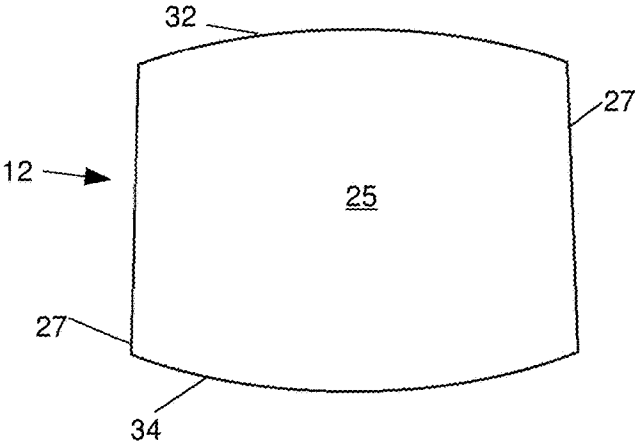
FIG. 3 is a front elevational view of a pivoting primary face shield of a face shield attachment for a hat brim in accordance with the principles of the invention.
Figure 4:
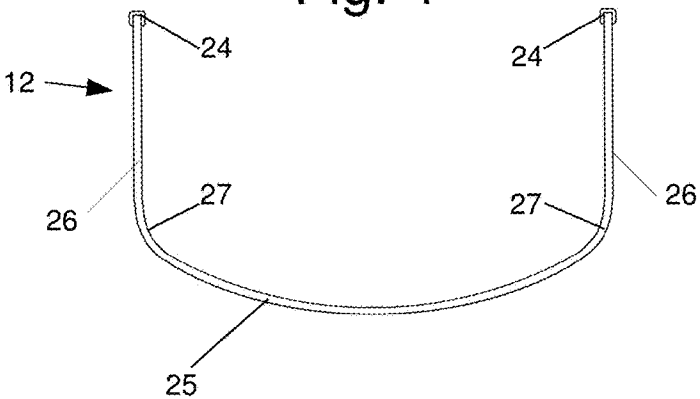
FIG. 4 is a top plan view of a pivoting primary face shield of a face shield attachment for a hat brim in accordance with the principles of the invention.

FIGS. 3, 4 and 5 show the primary face shield 12 in more detail. Referring to FIG. 3, the pivoting primary face shield 12 may have an anterior face shield 25 defines by an upwardly curving top edge 32 and a downwardly curving bottom edge 34. Optionally, top edge 32 and bottom edge 34 may be straight, angular or have a variety of other geometries. The sides of the anterior face shield 25 may be defined by the flexion lines 27 where the pivoting primary face shield bends to form the lateral wings 26 of the primary face shield 12. In this embodiment, the flexion lines 27 gradually taper outward from the top edge 32 to the bottom edge 34. Optionally, the flexion lines 27 may taper in the opposite direction or may be parallel to one another.

FIG. 4 shows anterior face shield 25 curving slightly between flexion lines 27. Optionally, the anterior face shield 25 may be substantially planar having little or no curve. The primary face shield 12 may bend sharply at each of the flexion lines 27 where it is joined to the lateral wings 26. Optionally, the flexion lines may bend less sharply or there may be no flexion lines at all and the primary face shield 12 may be substantially in the form of a half cylinder.

FIG. 5 shows an exemplary geometry for the lateral wings 26 of the primary face shield 12. In this embodiment, the lateral wings 26 has a flat, linear top edge 38 and a linear rear edge 40. The rear edge 40 shown here gently curves at its lower end to become the bottom edge 42 which may also be substantially linear. The bottom edge 42 may optionally be parallel to the top edge 38 or may taper downward as extends forward to the flexion line 27. The wings 26 of the primary face shield 12 may include a hole extending through it at a position close to the intersection of top edge 38, flexion line 27 and the top edge 32 of the anterior face shield 25. As explained in more detail below, hole 36 may serve as a pivot point for the primary face shield 12.

Figure 6:
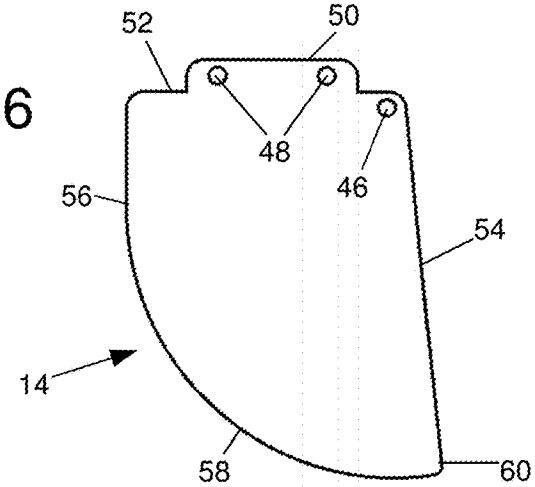
FIG. 6 is a front elevational view of a secondary lateral shield of a face shield attachment for a hat brim in accordance with the principles of the invention.

FIG. 6 shows a secondary lateral secondary shield 14. The lateral shields 14 may be substantially planar and having a substantially straight and linear forward edge 54. The rear edge 56 may curved gently downward to form a curved bottom edge 58 that may meet the forward edge 54 at corner 60. The top edge 52 may be substantially straight and may include an upwardly extending tab 50 having to holes 48 four connection to the attachment frame 16. The lateral shield 14 may also include a hole 46 through which a pivot pin may be placed to provide pivotal movement of the primary face shield 12 relative to the lateral secondary shield 14.

FIGS. 7-11 show the attachment frame 16, which may have a generally U shape. The attachment frame 16 may have a curved anterior section 17 extending between two lateral sections 64. The attachment frame may have an overall shape generally corresponding to the outline of a brim of a baseball cap. The attachment frame 16 may include a brim retention channel 68 defined by a superior ridge 67 and an inferior ridge 65. The brim retention channel 68 may be configured to accommodate the periphery of a brim of a common baseball cap. As mentioned above, the anterior section 17 of the attachment frame 16 may curved upward between the two lateral sections 64. The two lateral section 64 may generally be substantially straight and substantially parallel to one another. The brim retention channel 68, superior ridge 67 and inferior ridge 65 may extend across the entire the inside of the attachment frame 16 and terminating immediately anterior to the clips 20. The two lateral sections 64 may be substantially straight and parallel to one another.

In this embodiment, the clips 20 are spring biased alligator clips attached to the exterior side of the attachment frame 16 at the posterior end of each lateral sections 64. When at least parts of the periphery of a baseball cap's brim is inserted into the brim retention channel 68, the clips 20 may pinch each side of the brim to secure the brim in place within the brim retention channel 68. This may secure the attachment frame 16 to a baseball cap brim such that the attachment frame 16 remain substantially stationary to the baseball brim.

Figure 9:
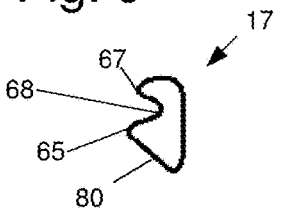
FIG. 9 is a cross-sectional view of a transverse anterior region of an attachment frame of a face shield attachment for a hat brim in accordance with the principles of the invention.

FIG. 9 shows an enlarged view of the cross section at line 78 of the anterior region 17 of the attachment frame 16. In the anterior region 17, the brim retention channel 68 between superior ridge 67 and inferior ridge 65 may be designed to accommodate and snugly fit about the front periphery of a baseball brim. Because the anterior periphery of a baseball may be substantially horizontal, i.e. substantially parallel to the horizontal reference line 69, this region of the brim retention channel 68 may be substantially horizontal also and parallel to the horizontal reference line 69. The bottom surface 80 of the anterior region 17 of the attachment frame 16 may be configured to act as a stop against the primary face shield 12 when it is pivoted upward. In this embodiment, the bottom surface 80 is substantially planar and angled approximately 45° relative to the horizontal direction 69 of the retention channel 68.

Figure 10:
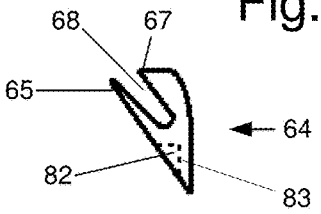
FIG. 10 is a cross-sectional view of a lateral region of an attachment frame of a face shield attachment for a hat brim in accordance with the principles of the invention.
Figure 10:
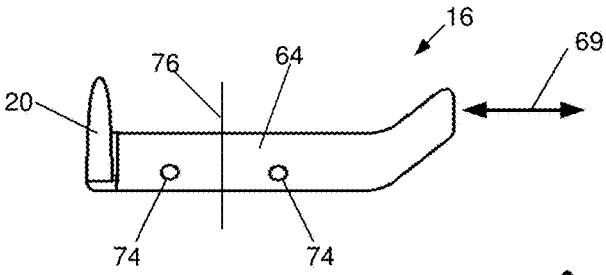
Figure 8:
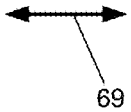
FIG. 8 is a side elevational view of an attachment frame of a face shield attachment for a hat brim in accordance with the principles of the invention.

FIG. 10 shows an enlarged view of a cross-section at line 76 of a lateral section 64 of the attachment frame 16. The brim retention channel 68 may be angled downward between superior ridge 67 and inferior ridge 65 to accommodate the lateral periphery of a baseball cap brim, which may also be sloped downward. FIG. 10 also shows a recess 82 having a substantially vertical back wall 83 that may include a mechanism for attaching a lateral secondary side shield to the lateral regions 64 of the attachment frame 16.

Figure 7:
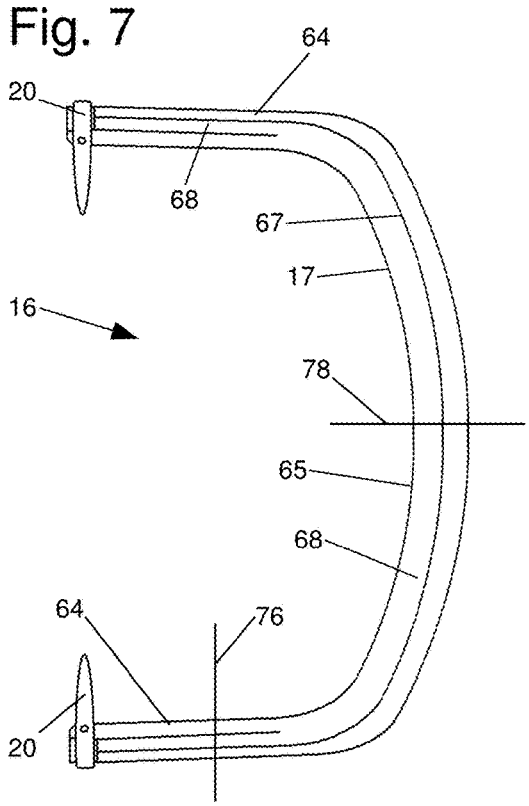
FIG. 7 is a top plan view of an attachment frame of a face shield attachment for a hat brim in accordance with the principles of the invention.
Figure 11:
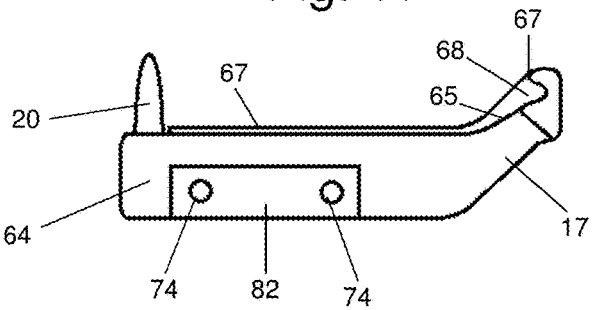
FIG. 11 is a side elevational view of the interior side of an attachment frame of a face shield attachment for a hat brim in accordance with the principles of the invention.

FIG. 11 shows the inside of the attachment frame 16 cutaway at line 78 of FIG. 7. Here it may be seen that the brim retention channel 68 curves along the length of the attachment frame 16, substantially mimicking the outline of a baseball cap. This may allow the brim retention channel 68 to contain some or all of the peripheral edge of a baseball cap, which may better secure it in place when the brim is engaged by the clips 20. In this embodiments, the recess 82 includes two holes 74 for accommodating bolts or rivets or other attachment mechanisms.

Figure 12:
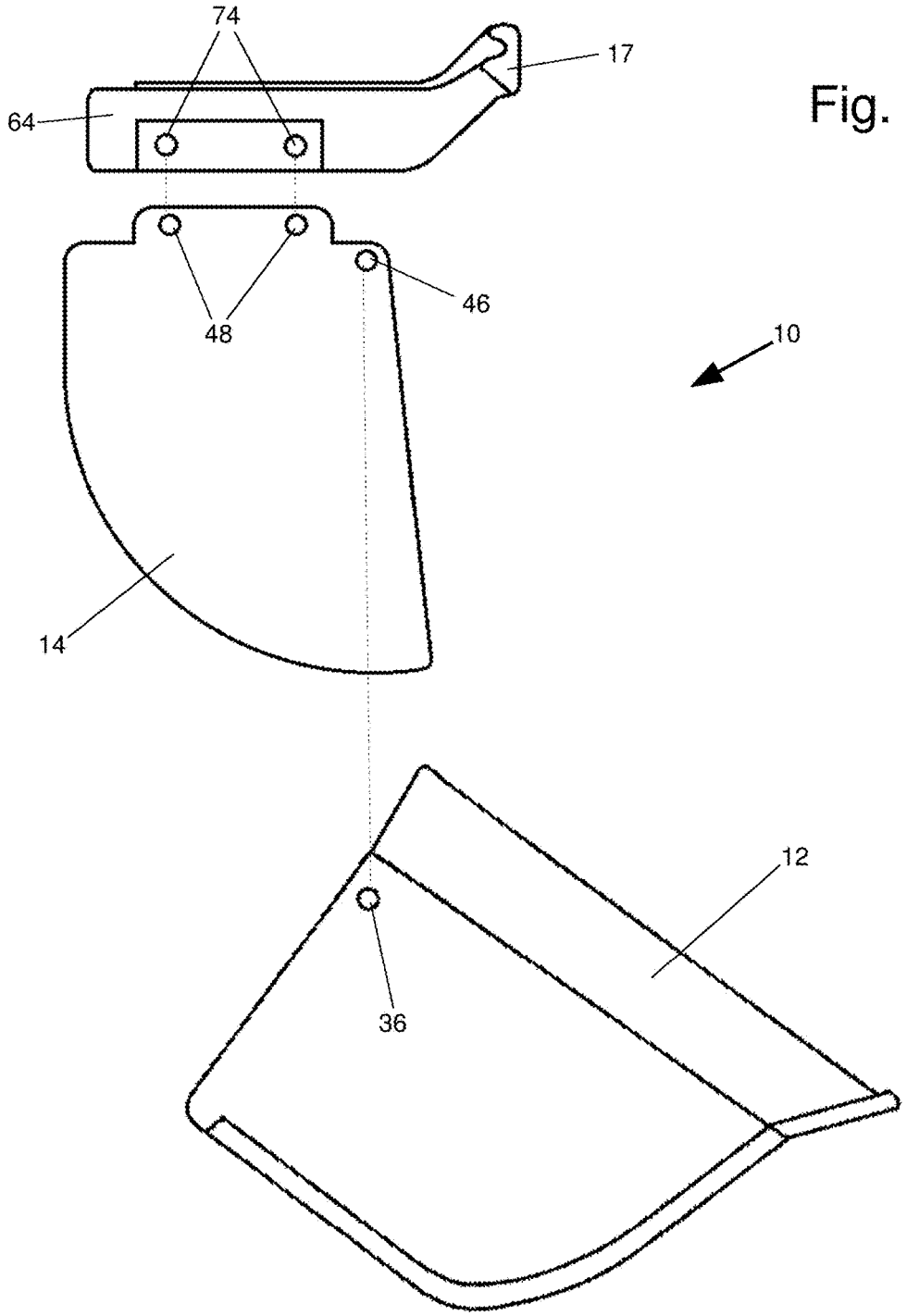
FIG. 12 is a cross-sectional side elevation exploded view of a face shield attachment for a hat brim in accordance with the principles of the invention.

FIG. 12 shows an exploded cross-sectional view of one half of a face shield attachment for a hat brim 10. During assembly of the face shield attachment 10, two bolts or rivets may be inserted through holes 48 in the secondary lateral shield 14 and through holes 74 in the lateral region 64 attachment frame 16. A pivot pin, which may be a bolt or a rivet or other device capable of providing pivoting movement may be placed through hole 36 of the primary face shield 12 and through hole 46 of the secondary lateral shield 14 hands allow the primary shield 12 to pivot in relation to the secondary shield 14. The bolt or rivets may provide a friction fit between the primary shield 12 and the secondary shield 14 sufficient to hold the primary face shield 12 in the secondary shield 14 in a desired position relative to each other, but not engaged too tightly to facilitate pivoting of the primary shield 12 and secondary shield 14 relative to each other.

Figure 13:
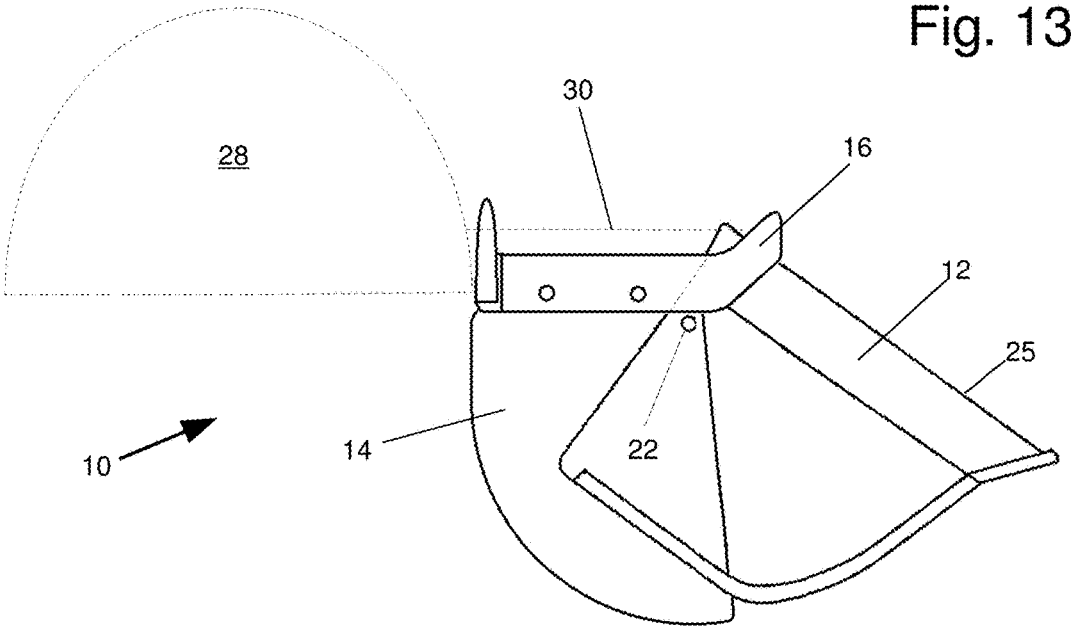
FIG. 13 is a side elevational view of a face shield attachment for a hat brim attached to a baseball cap and having a primary face shield pivoted into an up position in accordance with the principles of the invention.
Figure 14:
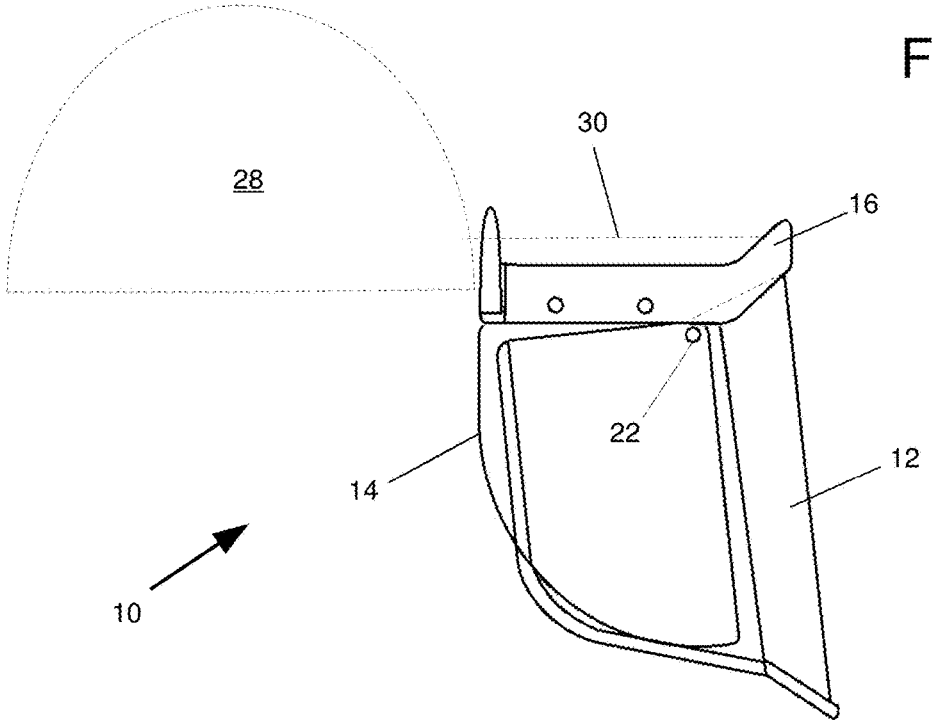
FIG. 14 is a side elevational view of a face shield attachment for a hat brim attached to a baseball cap and having a primary face shield pivoted into a down position in accordance with the principles of the invention.
Figure 15:
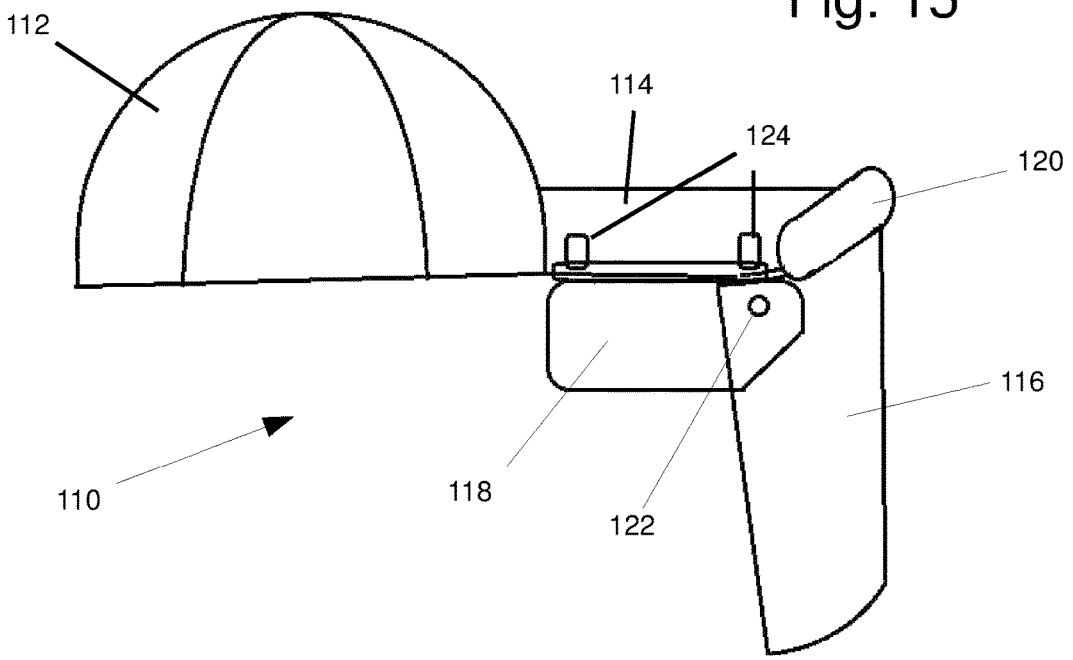
FIG. 15 is a side elevational view of an alternative embodiment of a face shield attachment for a hat brim attached to a baseball And having a primary face shield pivoted into a down position accordance with the principles of the invention.

FIGS. 13 and 14 show a face shield attachment for a hat brim 10 with the primary face shield pivoted into the up position and down position, respectively, and showing the position and orientation common baseball cap 28 having a brim 30 when the face shield attachment 10 is secured to the brim 30. The outer edge, or periphery, of the brim 30 is inserted into the brim retention channel on the inside of the frame 16. The clips 26 secure the brim in place inside the retention channel. In FIG. 13, the primary face shield 12 is pivoted upward approximately 45°, the maximum extent of upward rotation provided by the bottom 80 of the attachment frame 16. Because the pivot pin 22 provides a friction fit between the primary shield 12 and the secondary shield 14, the primary shield 12 may remain in the up position until it is pushed downward into the down position of FIG. 14.

FIGS. 15-18 show an alternative embodiment of a face shield attachment for a hat brim 110 removably affixed to a baseball cap 112 in accordance with the principles of the invention. The hat 112 may include a brim 114. Fasteners 124 of the face shield attachment 110 may be located at the top of the secondary lateral shield 118 and may removably engage the sides of the brim 114. The secondary lateral shield 118 may extend downward from the brim 114 and may shield the upper part of a user's face from the sides. Lateral shields 118 may be coextensive with the brim 114. Face shield 116 may be pivotally attached to the lateral secondary shields 118 by pivot pin 122. The upper edge of face shield 116 may include a lip 120 that extends in a posterior direction.

The face shield attachment 110 may be used with a baseball cap 112 or other similar headgear such as for example a hard hats, a visor, or any other headgear having a brim or visor to which fasteners 124 may be removably affixed. Fasteners 124 may be any suitable fastener, such as a clamp, an alligator clip and the like. Fasteners 124 may be biased by a spring or other mechanism, or may optionally use a nut and bolt or other mechanism for firmly engaging the brim 114. In this embodiment, two fasteners 124 extends from lateral shield 118. However, those skilled in the art will appreciate that it may be desirable to use more than two fasteners or two. Optionally use only a single fastener which may be larger and broader. It may be desirable to provide fasteners 124 that permanently affixed to a brim 114. Thus, fasteners 124 may comprise any device capable of affixing the shield assembly 110 to a brim 114.

Secondary lateral shield 118, may be substantially planar and may extend downward such that it shields the entire side of a user's face or optionally only the upper portion. In this embodiment, the lateral secondary shield 118 only protects the top portion of the side of the face. Optionally, Temple shield 118, may extend dorsally such that it protects all or part of the head in addition to the face.

In this embodiment, the primary face shield 116 extends downward to sufficiently shield a user's face. Primary face shield 116 may only slightly extend around to the side of a face. The primary shield 116 may optionally extend further about a user's face. The face shield 116. In this embodiment may also be substantially planar. Having a slightly convex curve. Optionally, face shield 116 may have more of a curve or may consist of one or more substantially planar sections and be more angular.

The lip 120 may be integral with the primary face shield 116, or may be a separate component attached to the upper edge of the primary face shield 116. In use, the primary face shield 116 may pivoted upward by the user. For convenience. When the face shield 116 is pivoted downward, the downward motion is limited by the lip's 120 engagement with the brim 114. The lip 120 extends in a dorsal direction such that when the face shield 116 is in the downward position the bottom of the lip 120 abuts and impinges upon the top of the brim 114.

Figure 16:
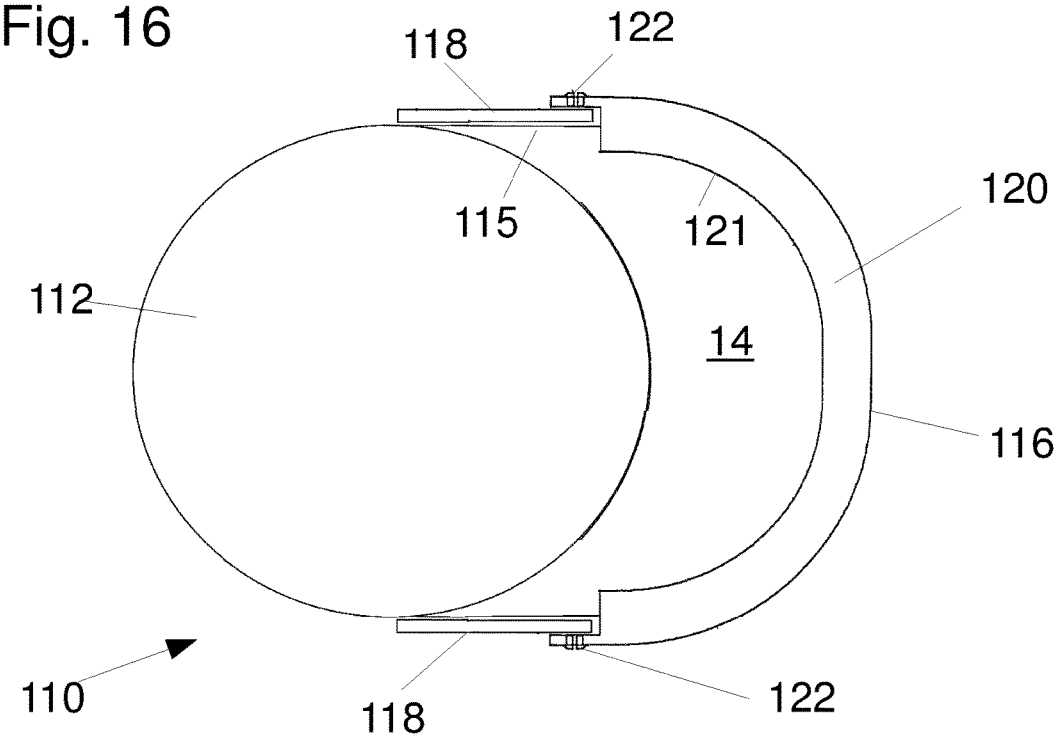
FIG. 16 is a top plan view of an alternative embodiment of a face shield attachment for a hat brim attached to a baseball cap in accordance with principles of the invention.

FIG. 16 shows the shield assembly 110 from the top. In this figure, it may be seen that the dorsal edge 121 of lip 120 extends over the edge 115 of brim 114. When the brim is in the down configuration, the dorsal edge 121 of the lip 120 abuts the top of brim 114. This may prevent the face shield 118 from prohibiting downward into an undesirable configuration.

Pivot pin 122 may be comprised of any pivoting mechanism known in the art. It may provide simple rotation or may be designed to friction only engage the face shield 116 and the secondary lateral shield 118 such that it does not freely slide, but retains the orientation between the lateral shield 118 and the face shield 116 resulting from an adjustment by the user. It may optionally include a nut and bolt, including a wing nut and bolt mechanism to adjust the amount of frictional engagement by the pivot pin. The pivot 110 may also optionally include internal stops for limiting the degree of rotation.

Face shield 116 and lateral shields 118, may be comprised of clear plastic, or other durable material. Optionally, the face shield 116 of the Temple shields 118 may include tinting, or may be adapted to accommodate an attachment providing tinting for use in bright sunlight or similar circumstances.

Figure 17:
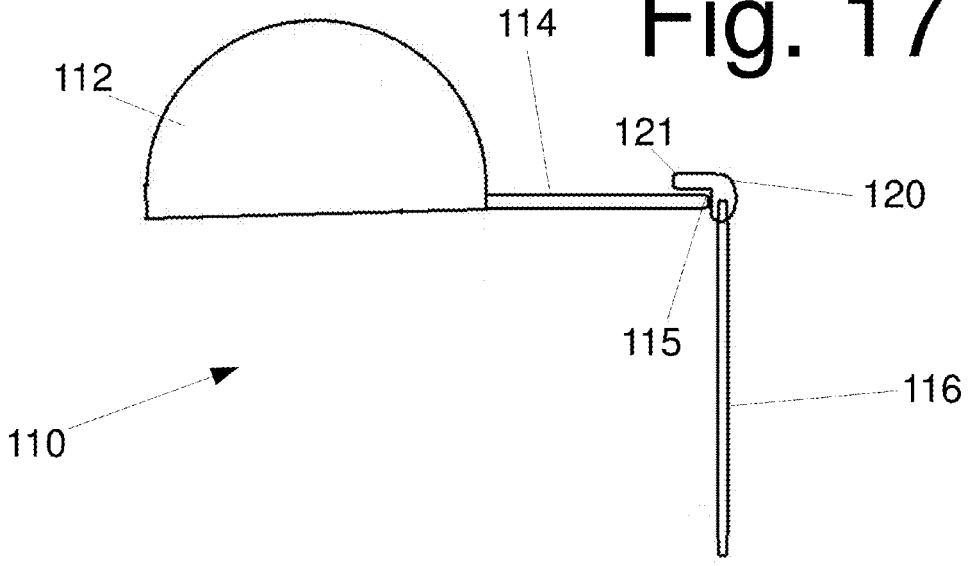
FIG. 17 is a side cross-sectional view of an alternative embodiment of a face shield attachment for a hat brim attached to a baseball in accordance with the principles of the invention.

FIG. 17 shows a side cross-sectional view of the face shield 116 and the baseball cap 112. It may be seen in this figure, that the dorsal end 121 of the lip 122 overlaps the edge 115 of the brim 114. This may prevent the face shield 116 from pivoting downward to an undesirable configuration. Lip 120 may also prevent liquids and particulate matter from passing around the face shield 116 and onto the face of the user.

Figure 18:
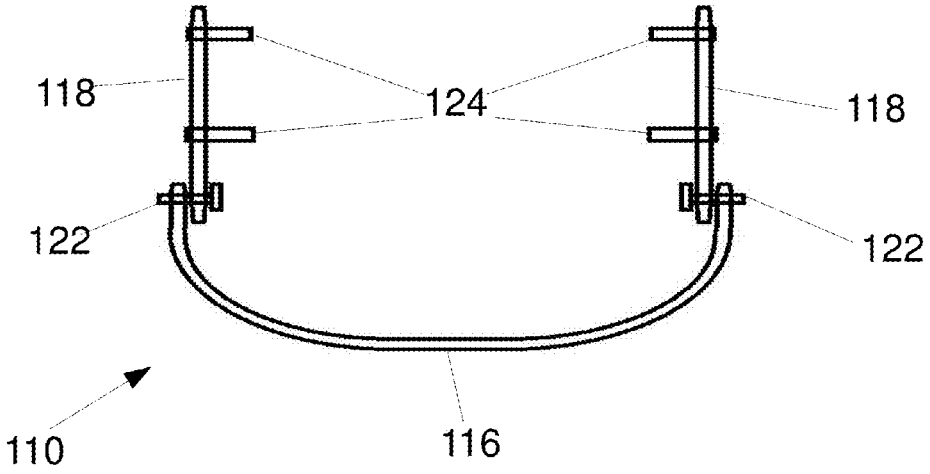
FIG. 18 is a top view of an alternative embodiment of a face shield attachment for a hat brim in accordance with the principles of the invention.

FIG. 18 shows a cross-section of the shield assembly 110. As discussed above, the four fasteners 124 may optionally comprise two fasteners or a plurality of several fasteners. It may also be desirable to include fasteners that extend over the top of the brim 114 and/or engage the cap 112.

Figure 19:
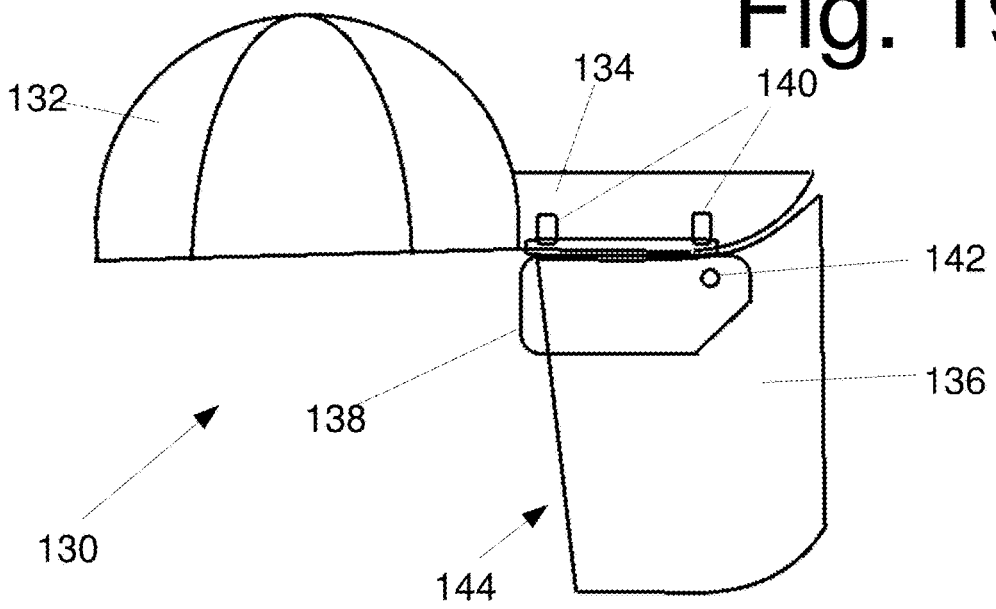
FIG. 19 is a side view of an alternative embodiment of a face shield attachment for a hat brim attached to a baseball in accordance with principles of the invention.
Figure 20:
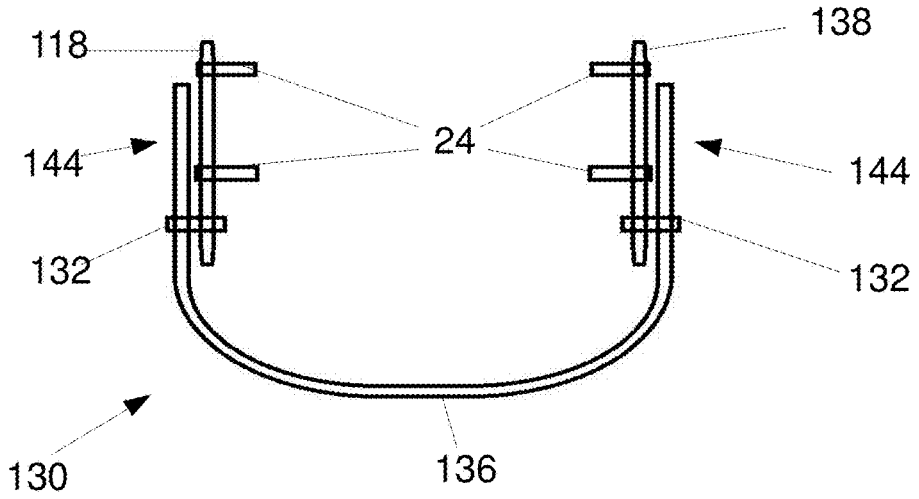
FIG. 20 is a top view of an alternative embodiment of a face shield attachment for a hat brim in accordance with the principles of the invention.

FIGS. 19 and 20 shows an alternative embodiment of a face shield attachment for a hat brim 130 attached to a baseball cap 132 in accordance with principles of the invention. This embodiment may also include two fasteners 140 attached to a Temple shield 138. The face shield 136 may be pivotally attached to the lateral shield 138 at pivot pin 142. In this embodiment, the face shield 136 does not include a lip for engaging the brim 134. The primary face shield 136 of this embodiment may include a side shield region 144 that may partially overlap the lateral secondary shield 138. This may provide additional protection to the side of a user's face.

Figure 21:
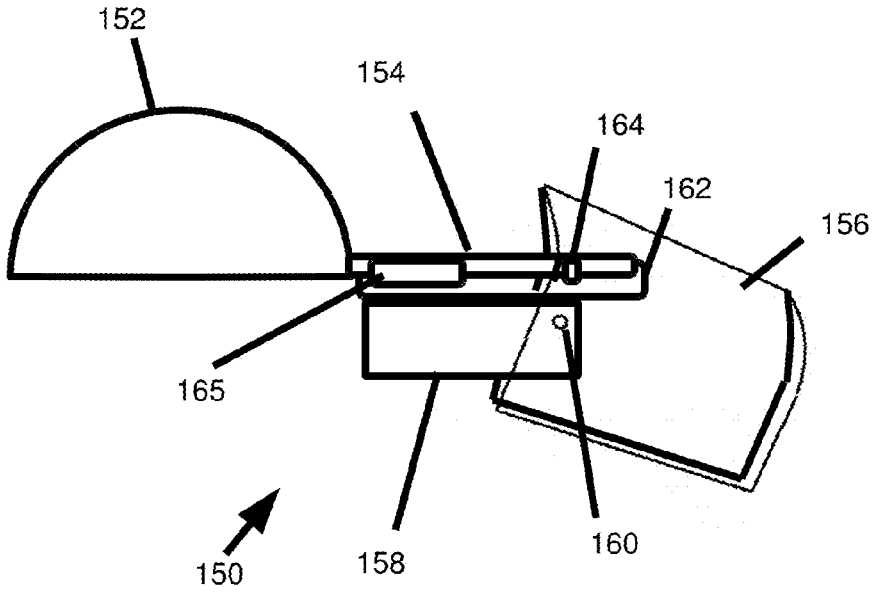
FIG. 21 is a side view of an alternative embodiment of a face shield attachment for a hat brim having a primary shield pivoted into and up position in accordance with the principles of the invention.

FIG. 21 shows an alternative embodiment of a shield assembly 150 in accordance with the principles of the invention. Baseball cap 152 has a brim 154 protruding outward. A U-shaped frame 162 fits about the periphery of brim 154. Frame 162 may include an attachment mechanism 165 and and attachment mechanism 164. One or both of these attachment mechanisms may removably engage the brim 154. Lateral shield 158 extends downward from the frame 162 on each side of the baseball cap 152. A face shield 156 is rotatably attached at pivot point 160.

In FIG. 21, the face shield 156 is shown in a partially raised configuration. The top edge of face shield 156 may impinge upon the periphery of the frame 162. In order to prevent the face shield 156, from rotating downward more than desired. As with other embodiments, the shield assembly 150 of FIG. 21 may include a face shield 156 that may prohibit all the way up and down sufficiently to cover a user's face.

Figure 22:
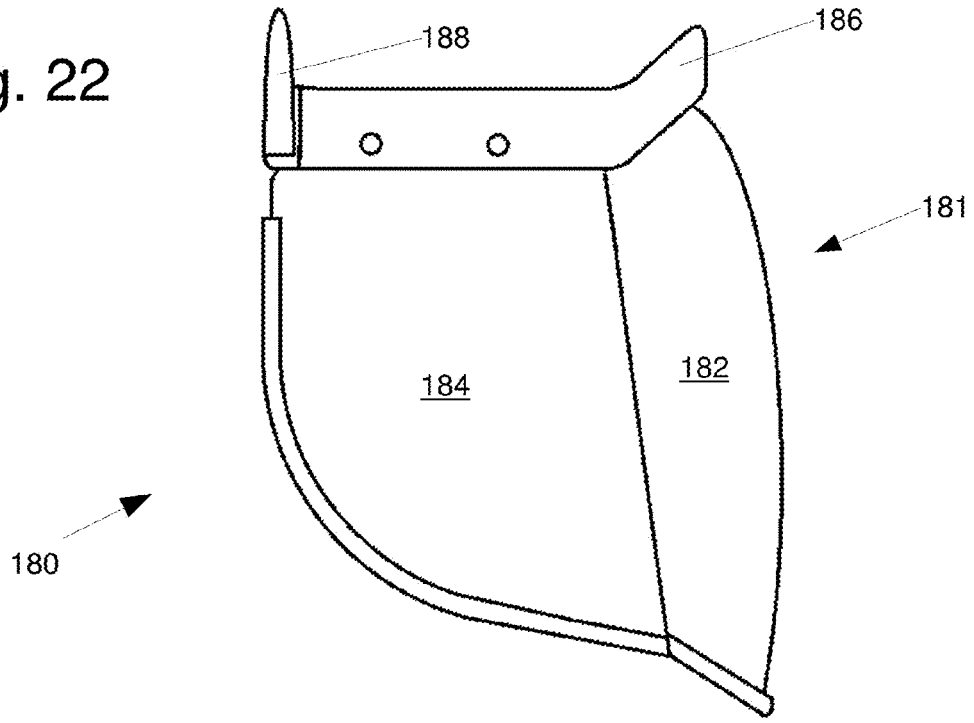
FIG. 22 is a side view of an alternative embodiment of a face shield attachment for a hat brim having a concave primary shield that is not configured to pivot in accordance with the principles of the invention.

FIG. 22 shows another alternative embodiment of a face shield attachment for a hat brim 180. In this embodiment, the face shield 181 does not pivot. The face shield includes an anterior shield 182 having a convex surface. It also includes two integral lateral shields 184 and may be secured to a hat brim using fasteners 188 on the frame 186.

Whereas, the present invention has been described in relation to the drawings attached hereto, it should be understood that other and further modifications, apart from those shown or suggested herein, may be made within the spirit and scope of this invention. Descriptions of the embodiments shown in the drawings should not be construed as limiting or defining the ordinary and plain meanings of the terms of the claims unless such is explicitly indicated.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

The invention claimed is:

1. A face shield attachment assembly comprising:

a hat including a brim, the brim having two lateral sides;

a face shield attachment comprising:

two transparent lateral shields, wherein each of the two lateral shields extend downward from one of the two lateral sides of the brim, respectively, and wherein each of the two lateral shields has two fasteners removably engaged with one of the two lateral sides of the brim, respectively;

an anterior primary shield made from a transparent material, the primary shield having an anterior primary portion defined by a top edge, a bottom edge, two side edges, and two lateral shield wings which each extend in a posterior direction from a respective one of two side edges of the anterior primary portion;

wherein each of the two lateral shield wings of the primary shield are pivotally attached by a pivot pin to one of the two lateral shields, and the primary shield is configured to translate between a down position and an up position by pivoting the primary shield about a pivot axis defined by the pivot pins; and wherein the primary shield further comprises a lip extending in a posterior direction from the top edge of the primary shield and abuts a top surface of the brim when the primary shield is in the down position, thereby limiting the downward rotation of the primary shield.

2. The face shield attachment assembly of claim 1, wherein each of the pivot pins are configured to be loosened to allow the primary shield to translate between the up position and the down position and are configured to be tightened to secure the primary shield in either the up position or the down position.

* * * * *